US007109925B2

(12) United States Patent
Noro et al.

(10) Patent No.: US 7,109,925 B2
(45) Date of Patent: Sep. 19, 2006

(54) ANTENNA DEVICE

(75) Inventors: Junichi Noro, Akita (JP); Toshihiko Inaba, Akita (JP)

(73) Assignee: Mitsumi Electric Co., LTD, Tokyo (JP)

( * ) Notice: Subject to any disclaimer, the term of this patent is extended or adjusted under 35 U.S.C. 154(b) by 3 days.

(21) Appl. No.: 10/874,282

(22) Filed: Jun. 24, 2004

(65) Prior Publication Data

US 2005/0068237 A1 Mar. 31, 2005

(30) Foreign Application Priority Data

Sep. 29, 2003 (JP) ..... P. 2003-336728

(51) Int. Cl.
*H01Q 1/38* (2006.01)

(52) U.S. Cl. ..... 343/700 MS

(58) Field of Classification Search ..... 343/700 MS, 343/702, 895, 846, 848, 873
See application file for complete search history.

(56) References Cited

U.S. PATENT DOCUMENTS 5,859,614 A * 1/1999 Paolella et al. ..... 343/700 MS
6,236,366 B1 * 5/2001 Yamamoto et al. .. 343/700 MS
6,281,844 B1 * 8/2001 Kodim et al. ..... 343/700 MS
6,567,049 B1 * 5/2003 Huang et al. ..... 343/700 MS
6,639,559 B1 * 10/2003 Okabe et al. ..... 343/700 MS
6,721,544 B1 * 4/2004 Franca-Neto ..... 455/83
2002/0067312 A1 * 6/2002 Hilgers ..... 343/700 MS
2002/0126049 A1 * 9/2002 Okabe et al. ..... 343/700 MS
2004/0056803 A1 * 3/2004 Soutiaguine et al. 343/700 MS

FOREIGN PATENT DOCUMENTS

JP 2001-68912 3/2001

* cited by examiner

*Primary Examiner*—Trinh Dinh
*Assistant Examiner*—Huedung X. Cao
(74) *Attorney, Agent, or Firm*—Whitham, Curtis, Christofferson & Cook P.C.

(57) ABSTRACT

The structure of an antenna device is simplified to reduce the size and cost. In an antenna case having a top cover and a bottom plate joined with each other, an antenna module receiving a signal transmitted from a GPS satellite, a low noise amplifier circuit (LNA circuit) directly provided on the ground plane of the antenna module for amplifying the signal received by the antenna module, and a shield case that shields the LNA circuit are provided.

14 Claims, 2 Drawing Sheets

ANTENNA DEVICE

BACKGROUND OF THE INVENTION

1. Field of the Invention

The present invention relates to an antenna device provided to a vehicle to receive signals transmitted from an artificial satellite, and more particularly, to a vehicle antenna device having a simplified structure so that the size and cost can be reduced.

2. Description of the Related Art

In recent years, a system to receive signal waves transmitted from multiple artificial satellites that orbit around the earth by a receiver and detect the present position of the receiver based on information included in the received signal waves has come into widespread use. The system is generally called GPS (Global Positioning System) in countries including Japan and the United States of America and typically uses the GPS satellites controlled by the U.S. Department of Defense, while there are similar systems such as Galileo in Europe and Glonass in the Russian Federation. Herein, the positioning system using artificial satellites, the artificial satellites for the positioning system, signal waves transmitted from the artificial satellites, and receivers receiving the signal waves will be referred to as GPS, GPS satellites, GPS signals, and GPS receivers, respectively for ease of representation.

The GPS allows the present position of a moving body to be detected highly accurately and almost in real time, and therefore the system is primarily used for measuring the present position of a moving body such as an automobile, an airplane, and a mobile telephone using a receiver provided in the moving body.

Today, GPS receivers suitable for automobiles, in other words, vehicle GPS receivers have rapidly come into widespread use. When such a GPS receiver is provided in an automobile, an antenna device for receiving a GPS signal is provided on the exterior of the automobile such as on the roof.

Also in recent years, a satellite broadcasting system in which signals including audio and video information are transmitted from a broadcasting satellite for broadcasting has been in wide use. At present, in the United States of America, audio sound information provided by such a satellite broadcasting system, so-called satellite radio broadcasting is provided by XM Satellite Radio Inc. In the satellite radio broadcasting, signals transmitted from a satellite can be received in a wide area on the earth, and therefore the broadcasting can be received and listened to not only in fixed locations such as in general households with a receiver, but also in a moving body (vehicle) such as an automobile with a receiver provided in the moving body. The latter case has attracted much attention.

An antenna device 100 as shown in FIG. 2 is an example of the vehicle antenna device to receive the above-described GPS signals or satellite broadcasting signals, in other words, signals transmitted from an artificial satellite.

As shown in FIG. 3, the conventional antenna device 100 includes an antenna module 101 including a ceramic material formed into a rectangular plate shape and antenna elements formed on both surfaces of the ceramic material, a circuit board 103 joined to one main surface of the antenna module 101 through an adhesive material 102 such as a length of double-faced adhesive tape, and a shield case 104 to shield the circuit board 103. Note that the antenna module 101 is connected with the circuit board 103 by feed pins 101*a* as shown in FIG. 3. The circuit board 103 is provided with electronic parts forming a low noise amplifying circuit (LNA circuit) that amplifies a signal received by the antenna module 101. The circuit board 103 is connected with an output cable 105 to extract the signal amplified by the LNA circuit to the outside (see Japanese Patent Laid-Open No. 2001-68912).

There has been a demand for smaller vehicle antenna devices in order to improve the appearance of the vehicle exterior. A so-called diversity method by which a number of antenna devices are provided to a vehicle has been suggested in order to improve the receiving sensitivity. By this method, a plurality of antenna devices must be provided to the vehicle, and the demand for smaller size, less costly antenna devices is strong.

The conventional antenna device 100 however includes a large number of parts as described above, and therefore there is a limit to the size and cost reduction.

SUMMARY OF THE INVENTION

The invention has been made in view of the above described circumstances associated with the conventional technique, and it is an object of the invention to provide a vehicle antenna device attached to a vehicle for receiving a signal transmitted from an artificial satellite having a simple structure, so that the size and cost may be reduced.

An antenna device according to the invention is provided to a vehicle and receives a signal transmitted from an artificial satellite. The device includes an antenna module stored in a main body case for receiving the signal, a low noise amplifying circuit provided directly on a ground plane of the antenna module for amplifying the signal received by the antenna module, and a shield case shielding the low noise amplifying circuit.

In the antenna device according to invention, the low noise amplifying circuit is provided on the ground plane of the antenna module, and therefore a circuit board and a member such as a length of double-faced adhesive tape to attach the circuit board that would otherwise be required by the conventional antenna device are not necessary. Therefore, the number of parts can significantly be reduced, and the structure can considerably be simplified.

In the antenna device according to invention, the low noise amplifying circuit is provided on the ground plane of the antenna module, and therefore a circuit board and a member to attach the circuit board that would otherwise be required by the conventional antenna device are not necessary. In this way, the size of the vehicle antenna device as a whole can readily be reduced, which contributes to the cost reduction.

DETAILED DESCRIPTION OF THE PREFERRED EMBODIMENTS

Now, an embodiment of the invention will be described in detail in conjunction with the accompanying drawings. Note that the invention is suitably applicable to an arbitrary antenna device that receives a satellite signal transmitted from an artificial satellite such as a vehicle antenna device that receives satellite radio broadcasting. In the following, a GPS receiving antenna 10 shown in FIG. 1 will be described as an application of the invention.

Figure 1:
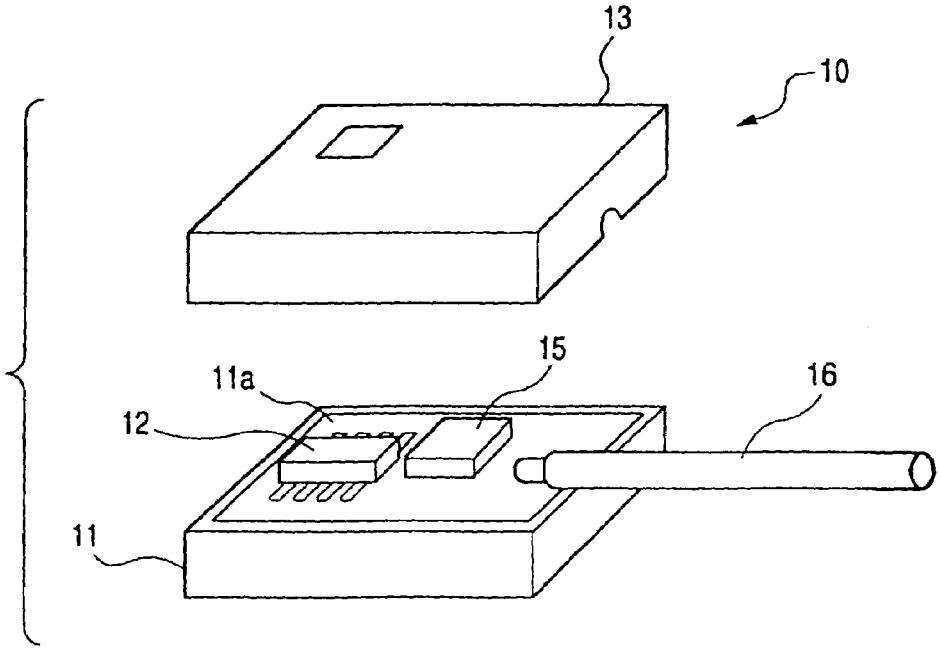
FIG. 1 is an exploded perspective view of a GPS receiving antenna according to an embodiment of the invention.

As shown in FIG. 1, the GPS receiving antenna 10 has an antenna case (not shown) having a top cover and a bottom plate joined with each other. In the antenna case, there are an antenna module 11 that receives a signal transmitted from a GPS satellite, a low noise amplifying circuit (LNA circuit) 12 provided at the ground plane 11*a* of the antenna module 11 to amplify the signal received by the antenna module 11, and a shield case 13 that shields the LNA circuit 12. The ground plane 11*a* is a face on which a ground pattern is provided.

The antenna module 11 includes a ceramic material in a rectangular plate shape and antenna elements formed on one surface of the ceramic material. A so-called planar patch antenna is thus formed. As shown in FIG. 1, the GPS receiving antenna 10 includes the LNA circuit 12 which is a single integrated circuit (chip) having various elements for the circuit integrated thereon. The LNA circuit 12 may be formed by providing a plurality of elements separately on a circuit pattern rather than in the form of the integrated circuit, but the form of the integrated circuit contributes more to the size reduction of the GPS receiving antenna 10.

On the ground plane 11*a* of the antenna module 11, a filter element 15 that extracts signals in a prescribed frequency band among signals received by the antenna module 11 is provided in addition to the LNA circuit 12. The GPS receiving antenna 10 can remove unwanted frequency components included in the received signals using the filter element 15, and therefore the receiving characteristic can significantly be improved.

The circuit formed on the ground plane 11*a* of the antenna module 11 is connected with an output cable 16 to extract signals to the outside.

Figure 2:
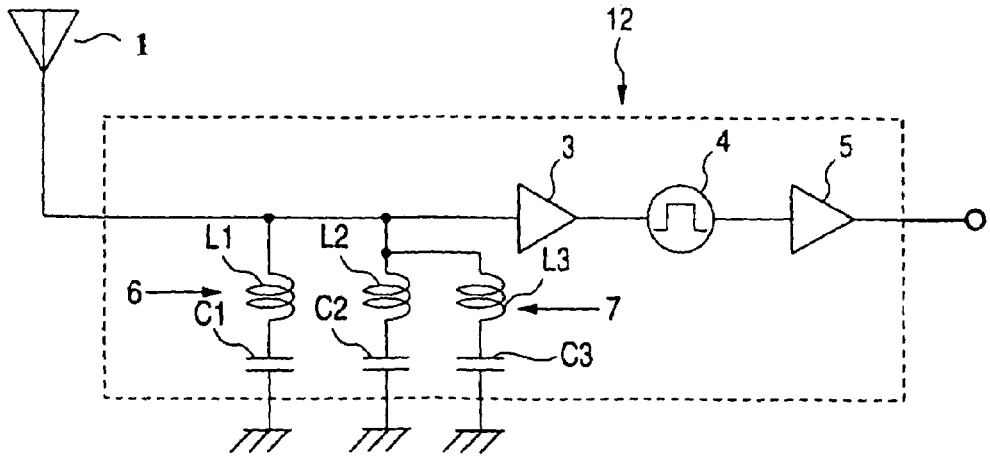
FIG. 2 is a circuit block diagram of the GPS receiving antenna according to the embodiment.
Figure 3:
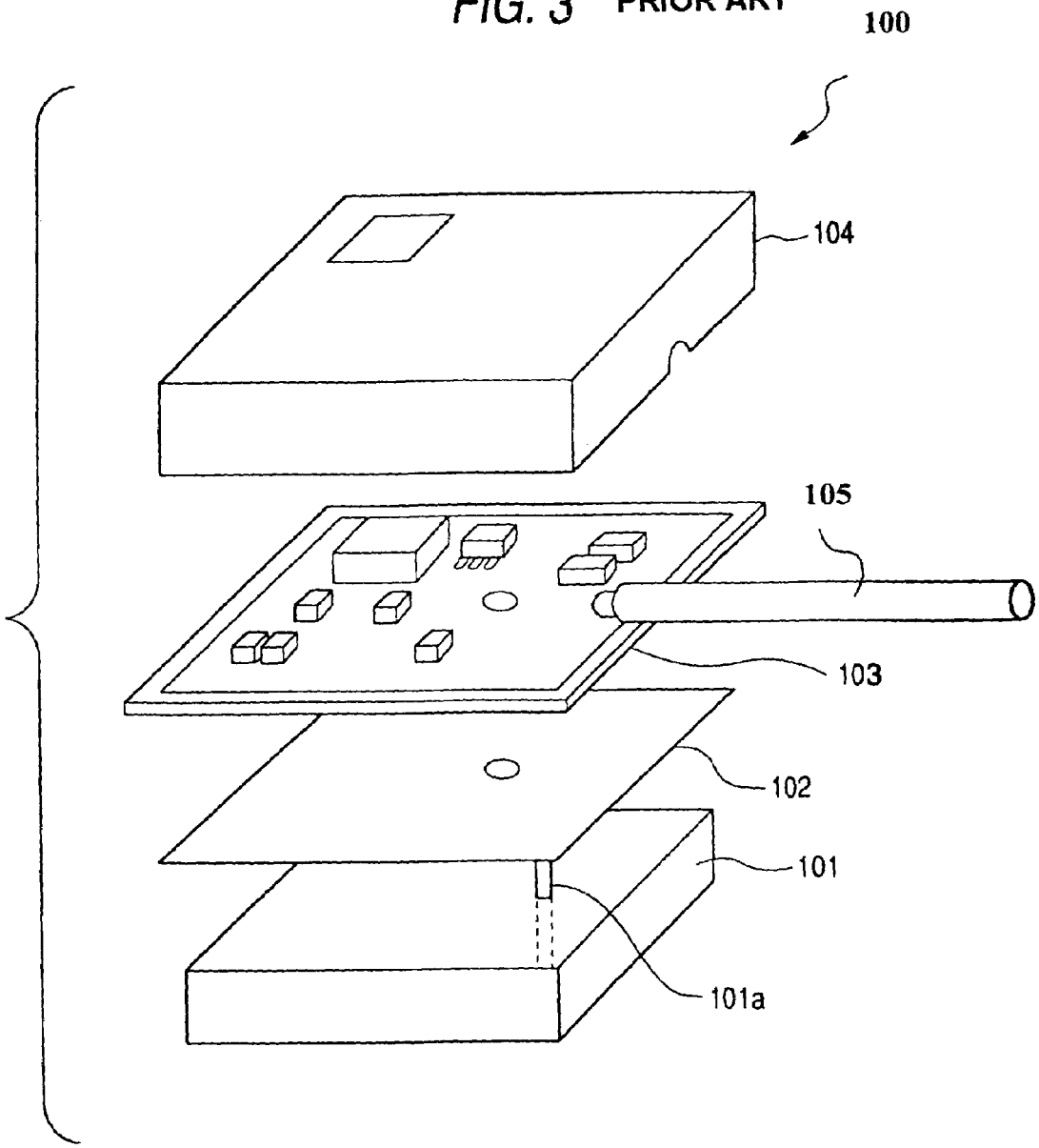
FIG. 3 PRIOR ART
FIG. 3 is an exploded perspective view of a conventional vehicle antenna device.

FIG. 2 is a block diagram of the circuit configuration of the antenna device 10. In the LNA circuit 12, a necessary interconnection pattern is directly formed on one surface of the antenna module 11, and parts necessary for the circuit configuration are directly mounted on the antenna module 11. The antenna module 11 having the LNA circuit 12 is packaged by the top cover and the bottom plate, so that the GPS receiving antenna device is formed. In the GPS receiving antenna device, an antenna connector is provided at the tip end of the output cable 16 for the LNA circuit 12, and the connector is connected to the antenna input terminal of the main body of the GPS device.

The LNA circuit 12 includes a first stage amplifier (LNA: Low Noise Amplifier) 3, a band-pass filter 4, and a second stage amplifier (LNA: Low Noise Amplifier) 5, and is operated for example in a frequency band of 1500 MHz.

Trap circuits are provided in the first stage of the LNA circuit 12, so that the circuit is designed to have frequency selectivity. More specifically, a first trap circuit 6 for trapping signals in the range from 800 MHz to 900 MHz, and a second trap circuit 7 for trapping signals in the range from 1800 MHz to 1900 MHz are connected. Note that the trap frequency is set to a frequency band for mobile phone for example, while the frequency band for mobile phone are different among countries and areas, and therefore the trap frequencies of the trap circuits 6 and 7 are adjusted depending on the country or area in which the device is used.

Herein, the first trap circuit 6 includes an inductor L1 and a capacitor C1 connected in series, and the second trap circuit 7 includes two systems of LC (inductance-capacitance) circuits (L2+C2 and L3+C3) connected in parallel. More specifically, the first and second trap circuits 6 and 7 are both an LC trap filter using LC.

In this way, since the trap circuits 6 and 7 are provided in the first stage of the LNA circuit 12, radio waves transmitted from a mobile phone received by an antenna part 1 are let to pass to GND through the trap circuit 6 or 7 depending on the frequency band, and waves produced by attenuating signals in the frequency bands other than the target range are input to the first stage amplifier 3. In this way, the first stage amplifier 3 is not saturated by the waves transmitted from the mobile phone, and receiving failure caused by the saturation of the first stage amplifier 3 and a drop in the amplifying degree in the GPS frequency band can be prevented.

In the above described GPS receiving antenna 10, the LNA circuit 12 and the filter element 15 are provided on the ground plane 11*a* of the antenna module 11, and therefore circuit boards needed by the conventional antenna device, or members for attaching the circuit boards are not necessary, which significantly reduces the number of parts. Furthermore, the structure can considerably be simplified. Consequently, the size of the GPS receiving antenna 10 as a whole can be reduced and the cost can be reduced.

What is claimed is:

1. An antenna device, comprising an antenna module, which includes:

a ceramic substrate, comprising a plurality of faces, at least one of which is configured as a ground face on which a ground pattern is provided; and an antenna element, provided on the ceramic substrate and adapted to receive a radio signal; and a low noise amplifying circuit, comprising a first and a second stage amplifier, and a first band filter connected between said first and second stage amplifier;

wherein the low noise amplifying circuit is provided as a semiconductor integrated circuit chip, and provided directly on the ground face and operable to amplify the radio signal.

2. An antenna module, comprising:

a ceramic substrate, comprising a plurality of faces, at least one of which is configured as a ground face on which a ground pattern is provided;

an antenna element, provided on the ceramic substrate and adapted to receive a radio signal;

a frequency trap circuit for trapping signals having frequencies in a band not of interest, wherein said a frequency band not of interest is a mobile phone band;

a low noise amplifying circuit, provided directly on the ground face and connected to receive signals in which frequencies in the band not of interest have been trapped.

3. The antenna module according to claim 2, wherein said mobile phone band can be adjusted depending on the area where said antenna device is used.

4. The antenna device according to claim 2, wherein said low noise amplifying circuit further comprising:

a first and second amplifier, a first band filter connected between said first and second stage amplifier, a first and second trap circuit preceding said first amplifier, wherein said first and second trap circuits trap signals having frequencies of band not of interest.

5. The antenna device according to claim 4, wherein said band not of interest is a mobile phone band.

6. The antenna device according to claim 5, wherein said mobile phone band can be adjusted depending on the area where said antenna device is used.

7. An antenna module, comprising:

a ceramic substrate, comprising a plurality of faces, at least one of which is configured as a ground face on which a ground pattern is provided;

an antenna element, provided on the ceramic substrate and adapted to receive a radio signal; and a low noise amplifying circuit, provided directly on the ground face and comprising:

a first and a second stage amplifier, a first band filter connected between said first and second stage amplifier, and a first and a second trap circuits preceding said first stage amplifier, wherein said first and second trap circuits trap signals having frequencies of band not of interest.

8. The antenna module according to claim 7, wherein the low noise amplifying circuit is provided as a semiconductor integrated circuit chip.

9. The antenna module according to claim 7, wherein said band not of interest is a mobile phone band.

10. The antenna module according to claim 9, wherein said mobile phone band can be adjusted depending on the area where said antenna device is used.

11. An antenna module, comprising:

a ceramic substrate, comprising a plurality of faces, at least one of which is configured as a ground face on which a ground pattern is provided; and an antenna element, provided on the ceramic substrate and adapted to receive a radio signal; and a low noise amplifying circuit, provided directly on the ground face and operable to amplify the radio signal, wherein said low noise amplifying circuit comprises:

a first trap circuit for letting go to the ground radio waves transmitted from a mobile phone of first frequency;

a second trap circuit for letting go to ground radio waves transmitted from a mobile phone of second frequency; and a low noise amplifier receiving radio wave signals from said first and second trap circuits without radio waves trapped by said first and second trap circuits.

12. The antenna module according to claim 11, further comprising:

a filter element, provided directly on the ground face and operable to extract a signal having a predetermined frequency band from the radio signal.

13. An antenna device, comprising:

an antenna module, which includes:

a ceramic substrate; and an antenna element, provided on the ceramic substrate and adapted to receive a radio signal;

a low noise amplifying circuit, comprising a first and a second stage amplifier and a first band filter connected between said first and second stage amplifier, and operable to amplify the radio signal;

wherein the low noise amplifying circuit is provided as a single semiconductor integrated circuit chip.

14. An antenna device, comprising:

an antenna module, which includes:

a ceramic substrate; and an antenna element, provided on the ceramic substrate and adapted to receive a radio signal;

a band pass filter; and a low noise amplifying circuit, comprising a first stage amplifier and a second stage amplifier, the first stage amplifier connected to a front of the band pass filter, and the second stage amplifier connected to a rear of the band pass filter;

wherein the low noise amplifying circuit is provided as a single semiconductor integrated circuit chip.

* * * * *